United States Patent [19]

Edwards

[11] 4,448,239

[45] May 15, 1984

[54] HEAT-PIPE-DIODE-CHARGED THERMAL

[75] Inventor: Donald K. Edwards, Irvine, Calif.

[73] Assignee: The United States of America as represented by the Secretary of the Army, Washington, D.C.

[21] Appl. No.: 369,314

[22] Filed: Apr. 16, 1982

[51] Int. Cl.[3] ..... F28D 15/00

[52] U.S. Cl. ..... 165/47; 165/104.14; 165/104.19; 165/104.21

[58] Field of Search ..... 165/104.14, 104.21, 165/104.19, 47; 126/437

[56] References Cited

U.S. PATENT DOCUMENTS 4,380,993 4/1983 Spitzer ..... 126/437 X

FOREIGN PATENT DOCUMENTS 45481 2/1982 European Pat. Off. ..... 165/104.19

2754981 6/1978 Fed. Rep. of Germany ..... 165/104.14

56-160534 12/1981 Japan ..... 126/437

*Primary Examiner*—Albert W. Davis, Jr.

*Attorney, Agent, or Firm*—Robert P. Gibson; Anthony T. Lane; Harold H. Card, Jr.

[57] ABSTRACT

Heat-pipe-diodes are used to charge a thermally-stratified heat reservoir to permit enhanced preheating of feed water. Maximum available energy is automatically extracted from waste and feed streams having intermittent flow and variable temperature. The thermal reservoir comprises a plurality of thermosyphons operatively disposed in a condenser unit through which the feed water passes, and a plurality of fluidically connected heat-receiving diodes operatively disposed in an evaporator unit through which the waste stream flows.

6 Claims, 2 Drawing Figures

HEAT-PIPE-DIODE-CHARGED THERMAL

GOVERNMENTAL INTEREST

The invention described herein was made in the course of a contract with the Government and may be manufactured, used and licensed by or for the Government for Governmental purposes without the payment to me of any royalty thereon.

BACKGROUND OF THE INVENTION

In many industrial plants hot wash water, after use, is sent to a water drain from a batch tank and cold water is then drawn from a main to refill that tank or another tank. The cold water must then be heated by steam coils or other energy means. This process is often repeated with each rinse cycle many times during the course of a year. Since hot water is what is desired, and energy is used to heat the cold water, it would be desirable to preheat the incoming water from the main by recouping heat from the hot waste water in order to reduce energy costs. Prior art simple process-heat exchanges are not suitable for such batch-process applications, because of intermittent flows and variable temperatures encountered.

Thermal reservoirs are used when hot waste is discharged but cold feed at a balanced flow rate is not flowing at the same time. The thermal reservoir in this instance serves to store heat from the hot stream and at a later time when energy is needed transfers heat into the cold stream. There are two main types of thermal reservoirs, the open system and the closed system. The open reservoir system stores heat in the working fluid. The closed reservoir system receives heat and stores it in an intermediate thermal medium, such as rocks or pressurized water, before transferring it to the stream to be heated.

Where the temperature of the stream going to waste is steady, the waste stream is passed directly through the thermal reservoir, entering at a high temperature end and leaving at a low temperature end. In the case of an open thermal reservoir, the top would be the high temperature end and the bottom the cold end. Thermal stratification is used to slow mixing in the tank. Mixing is undesirable, because available energy is lost when high temperature regions are allowed to mix or transfer heat with low temperature regions. Tubes in this instance can pass through the thermal reservoir from top to bottom. One of the problems with these prior art devices is that it is not generally convenient to pump waste water to the top of a reservoir. The use of short thermal reservoir is undesirable because thermal stratification is not as effective in blocking heat transfer.

Another problem is encountered with prior art devices where the waste stream is variable in temperature. In this instance cold as well as hot rinse water is sent to waste. Cold fluid entering the hot end of the reservoir cools it and disturbs the thermal stratification. In addition when the hot end of the reservoir is cooled, the discharge water from the reservoir is no longer hot and the heat load on an after-heater is increased.

The present invention permits a waste stream exchanger to be positioned at a low level and at a short and somewhat remote location. The present invention permits a waste stream to have a variable temperature without degrading the desirable high temperature strata in a thermal reservoir. In addition when high temperature waste becomes available, the present device automatically charges the highest temperature strata first, thus conserving the greatest amount of available energy.

SUMMARY OF THE INVENTION

The present invention relates to a charged heat-pipe-diode (thermosyphons) closed thermal reservoir system for preheating hot wash water. The present closed thermal reservoir system comprises a plurality of heat pipe diodes operatively disposed in a condensing section of thermally-stratified heat reservoir which is fluidically connected by gravity feed to a baffled evaporating section. The present invention permits maximum available energy to be extracted from a waste stream which is intermittent in flow and variable in temperature.

An object of the present invention is to provide a heat-pipe-diode charged closed thermal reservoir system for more efficiently heating wash water.

Another object of the present invention is to provide a thermal reservoir which permits maximum available energy to be automatically extracted from waste and feed streams which have intermittent flows and variable temperatures.

Another object of the present invention is to provide a thermal reservoir having a waste stream removed from the reservoir, a more desirable shape, and having a waste tank with a lower elevation than the reservoir.

A further object of the present invention is to insure that thermal energy is automatically extracted from the hottest portion of an outlet waste stream and to put this energy into the hottest protion of a thermal reservoir.

DESCRIPTION OF THE PREFERRED EMBODIMENTS

Figures 1, 2:
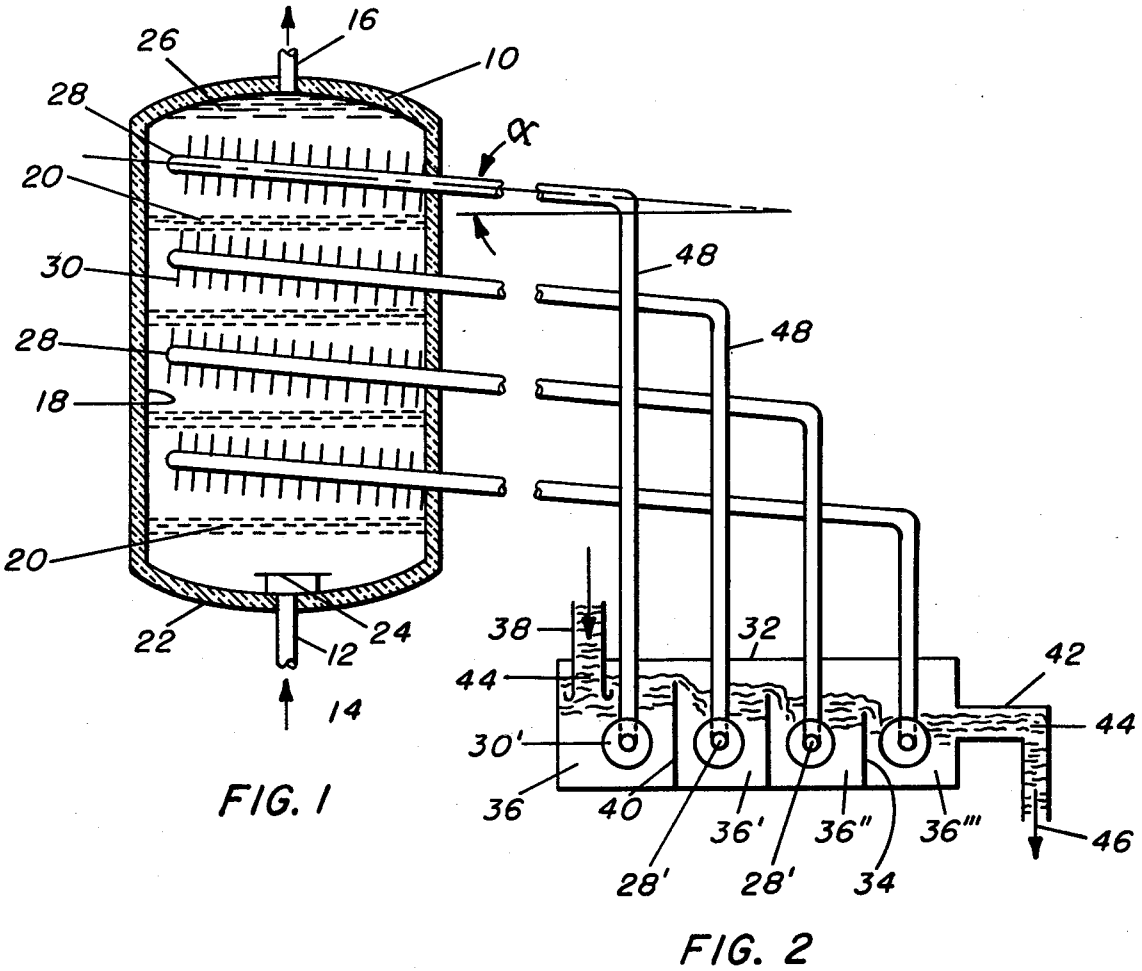
FIG. 1 is a partial cross-sectional schematic view of a thermal reservoir condenser section of the heat-pipe-diode charged closed system.
FIG. 2 is a schematic view of the evaporator section of the thermal reservoir system.

Referring now to FIG. 1, a thermally insulated vessel 10 has an inlet connection 12 at its lower end connected to receive fluid from a main source whose direction of flow is indicated by arrow 14. An outlet connection 16 is provided at the upper end of tank 10 for delivering heated feed material to a batch rinse tank, not shown. The tank interior wall 18 is used to support a plurality of horizontally spaced screens 20. The tank bottom end 22 supports a baffle plate 24 thereon. The screens 20 and the baffle plate 24 serve to dampen turbulent mixing in the thermally insulated vessel 10. Within each stratum of feed fluid 26 a heat-pipe condenser, or thermosyphon, 28 is operatively positioned. External fins 30 are fixedly attached to heat-pipe condenser 28 to help balance the area-heat-transfer-coefficient product. Condenser heat-pipe 28 may also include integral fins or ribs, (not shown) on an internal wall of the condenser tubing. The condenser heat-pipe-diodes 28 are pitched at an acute angle to help condensed liquids flow by gravity down the heat-pipe-diode 28 to the evaporator section which is located in the waste stream as shown in FIG. 2.

Referring now to FIG. 2, a waste fluid holding tank 32 has a plurality of baffle walls 34 which divide waste tank 32 into multiple decreasingly sized compartments 36, 36', 36'' and 36'''. A hot waste inlet 38 passes through the top of the tank 32 into compartment 36. Compartment 36 has the highest baffle wall member 40. A waste tank output pipe 42 is connected to the side of compartment 36''' at a level which permits the waste fluid 44 to exit by gravity in the direction shown by arrow 46. Each of the compartments 36-36''' contain heat-receiving pipes 28' horizontally disposed therein and fins 30' fixedly positioned along the length thereof. The heat-receiving-pipe-diodes 28' are fluidically connected to heat-donating pipes 28 by vertical riser pipes 48. The pipes may be made of a metal such as copper or of steel and the heat-pipe fluid contained therein may be water or ammonia. Water as a heat-pipe fluid has two disadvantages. Firstly, to avoid the generation of non-condensable gas the tube material must be made of relatively expensive copper. Secondly, since heat pipes will often operate with the vapor below 100° F., a very low vapor density results in the fluid having high velocity. Ammonia is the best choice in this type of application and is used in the preferred embodiment. Ammonia can be used with inexpensive steel tubes. It has a much higher vapor density than water and avoids the relatively low sonic limits associated with water when it is used as a heat-pipe fluid energy transfer means.

In operation condensed fluid from the condensers 28 flows by gravity down the vertical pipes 48 to the evaporator heat-pipe-diode receiving member 28, which as previously stated are located in the waste stream 44. When and only when, the evaporator section temperatures exceed the stratum condenser temperatures, does vapor flow from the evaporator sections of FIG. 2 to the condenser sections of FIG. 1, thus providing a high rate of heat transfer. When the thermal reservoir 10 feed or wash fluid 26 on the condenser heat-pipe-diodes 28 is warmer than the waste stream 44 temperature in the evaporator heat-pipes 28', the condenser heat-pipe-diodes 28 dry out, and the evaporator heat-receiving-diode 28' fill with subcooled liquid so that no heat transfer occurs. It is this feature which protects the availability of energy in the thermal reservoir 10. Thus thermodynamic availability is automatically conserved. Thermal energy is automatically extracted from the hottest portion of the outlet stream, by the heat-receiving-diode in compartment 36 of waste tank 32 and put into the hottest portion of the thermal reservoir, namely the upper section of the thermal reservoir 10. When the hottest portion of the waste outlet stream 44 is colder than the hottest portion of the feed fluid 26 no transfer occurs, but heat is extracted in other portions of the reservoir, thus assuring maximum heat recovery. In this specific embodiment both the waste and feed streams may be intermittent in flow and variable in temperature without effecting the efficiency of heat transfer.

The foregoing disclosure and drawings are merely illustrative of the principles of this invention and are not to be interpreted in a limiting sense. The screens 20, fins 37 and baffles 34 are optional elements. I wish it to be understood that I do not desire to be limited to the exact details of construction shown and described for obvious modifications will occur to a person skilled in the art.

What is claimed is:

1. A heat-pipe-diode charged thermal reservoir which comprises:

tank means for holding a reserve of heated feed water, which includes;

a feed water vessel having thermally insulated walls;

an outlet connection for hot feed water operatively disposed on an upper end of said vessel;

an inlet connection for incoming cold feed water operatively disposed on a lower end of said vessel; and a baffle member fixedly positioned on the bottom of said vessel opposite said inlet connection, said baffle member helping to stratify feed water in said vessel;

means for stratifying said feed water in said tank means, which includes;

a plurality of horizontally spaced apart screens supported from the interior walls of said vessel;

means for holding a waste stream remote from said tank means, which includes;

a compartmented evaporator tank, operatively disposed at a lower level than said tank means, having a waste fluid inlet connected to a top side of a first compartment and a waste tank output connection positioned at a lower level on the side of another compartment;

baffle means for dividing said waste stream flow and for permitting overflow of waste stream from said first compartment to other compartments, which includes;

a plurality of baffle walls for dividing said tank into multiple decreasingly sized compartments for permitting waste fluid to exit by gravity in the direction of the waste fluid flow;

means for automatically extracting heat from said waste stream and for using said heat to preheat incoming and stored feed water; which includes a plurality of inclined heat-pipe-diode condenser members operatively disposed between each layer of said means for stratifying;

a plurality of heat receiving members fluidically connected to said condenser member, and horizontally disposed in separate sections of said compartments evaporator tank;

a plurality of vertical pipes fluidically connecting each of said condenser members to a receiving member, said condenser member located in the hottest and upper stratum of said feed water vessel is fluidically coupled to a receiving member located in the hottest compartment of said evaporator tank, each progressively cooler condenser member being fluidically connected to a progressively cooler receiving member in said evaporator tank; and a heat transfer fluid sealed in each of said condensor and receiving members.

2. A thermal reservoir as recited in claim 1 wherein said heat transfer fluid includes a readily condensable gas such as ammonia.

3. A thermal reservoir as recited in claim 2 wherein the longitudinal axes of said plurality of heat-pipe-diode condenser members are inclined at an acute angle.

4. A thermal reservoir as recited in claim 3 wherein said plurality of heat-pipe-diode condenser members include a plurality of fixedly attached fins.

5. A thermal reservoir as recited in claim 8 wherein said plurality of heat receiving members include a plurality of fins fixedly attached thereto.

6. A thermal reservoir as recited in claim 4 wherein said plurality of heat-pipe-diode condenser and receiving members, and vertical pipes are made of a ferrous material.

* * * * *